US011272284B2

(12) United States Patent
North

(10) Patent No.: US 11,272,284 B2
(45) Date of Patent: Mar. 8, 2022

(54) OPEN-BACK LINEAR BI-DIRECTIONAL CABINET FOR SPEAKER DRIVER

(71) Applicant: Jeffrey P. North, Chantilly, VA (US)

(72) Inventor: Jeffrey P. North, Chantilly, VA (US)

( * ) Notice: Subject to any disclaimer, the term of this patent is extended or adjusted under 35 U.S.C. 154(b) by 0 days.

(21) Appl. No.: 15/889,960

(22) Filed: Feb. 6, 2018

(65) Prior Publication Data

US 2019/0246199 A1 Aug. 8, 2019

(51) Int. Cl.
*H04R 31/00* (2006.01)
*H04R 1/28* (2006.01)
*H04R 1/02* (2006.01)

(52) U.S. Cl.
CPC ..... *H04R 1/2811* (2013.01); *H04R 1/025* (2013.01); *H04R 31/00* (2013.01)

(58) Field of Classification Search
CPC .... H04R 1/345; H04R 1/2803; H04R 1/2888; H04R 1/2811; H04R 31/00; H04R 1/025
USPC ..... 381/338, 351, 336; 181/199, 195
See application file for complete search history.

(56) References Cited

U.S. PATENT DOCUMENTS 2,905,259 A * 9/1959 William ..... H04R 1/323 181/159
3,638,753 A * 2/1972 Cunningham ..... H04R 1/345 181/153
3,720,787 A * 3/1973 Ishii ..... H04R 1/02 181/147
3,818,138 A 6/1974 Sperrazza, Jr.
5,009,281 A * 4/1991 Yokoyama ..... H04R 1/2811 181/153
5,721,401 A * 2/1998 Sim ..... H04R 1/345 181/148
5,929,393 A 7/1999 Jeter, Jr.
6,411,721 B1 * 6/2002 Spindler ..... H04R 1/26 181/153
6,519,348 B1 * 2/2003 Ikeuchi ..... H04R 1/345 181/152
6,678,384 B2 1/2004 Kowaki et al.
8,139,805 B2 * 3/2012 Tsai ..... H04R 1/2853 381/150
8,757,317 B1 * 6/2014 Wang ..... H04R 1/30 181/153
8,857,559 B2 10/2014 Reviel
9,282,388 B2 3/2016 Wegener
9,457,932 B2 10/2016 Kenealy et al.
2007/0064958 A1 * 3/2007 Nakamura ..... H04R 1/345 381/71.1

* cited by examiner

*Primary Examiner* — Blake A Tankersley
(74) *Attorney, Agent, or Firm* — Covington & Burling LLP

(57) ABSTRACT

A cabinet for housing a round, open-back, cone type driver. The cabinet includes a barrel-shaped internal wall that has first and second opposing open ends and a substantially circular cross section. The diameter of the cross section at the midpoint of the internal wall is greater than the diameter of the internal wall at the opposing open ends. A mounting ring is secured to the internal wall between approximately a front quarter and a back quarter of the cabinet, configured for receiving the driver.

11 Claims, 11 Drawing Sheets

OPEN-BACK LINEAR BI-DIRECTIONAL CABINET FOR SPEAKER DRIVER

TECHNICAL FIELD OF INVENTION

Embodiments of the present invention generally relate to cabinetry for an audio speaker driver. More particularly, embodiments of the present invention relate to a barrel-shaped cabinet having two opposing open ends and an internal mounting ring for a round, open-back, cone type driver, which maximizes the use of sound pressure waves generated by both the front and back of the speaker driver, without noticeable cancellation or distortion of the sound pressure waves.

BACKGROUND OF THE INVENTION

The design of audio speaker cabinets ("cabinet" or "cabinets"), which can include one or more speaker drivers ("driver" or "drivers"), has developed, in part, around the principle that sound pressure waves generated by the front of a driver are a half cycle (180 degrees) out of phase with those generated by the back of the driver. Consequently, when sound pressure waves from the front of a driver meet sound pressure waves from the back of the driver, destructive interference can occur, whereby waves of the same frequency and amplitude sum to zero, resulting in cancellation of the sound pressure waves. This, in turn, leads to a reduction in sound quality (e.g., dead spots) in the room or physical space surrounding a driver.

As used herein, a driver is an individual loudspeaker transducer that converts an electrical audio signal to sound waves. Drivers can be generally thought of as being a woofer, a midrange, or a tweeter. A known driver technology is referred to as a dynamic driver, or cone type driver. Dynamic drivers are identifiable by their familiar cones and domes. Conventional cone type drivers typically include a cone, a frame, a voice coil, a magnetic circuit, etc. Cone type drivers are typically mounted to the front face of a cabinet.

Woofers are the largest drivers, and produce low frequency sounds. Midrange drivers produce a range of frequencies in the middle of the sound spectrum. Tweeters are the smallest drivers, and produce sounds in the highest frequencies. Other drivers include full-range, coaxial, subwoofers and supertweeters. A full-range driver is a driver that reproduces as much of the audible frequency range as possible. A coaxial driver is a loudspeaker driver with two or several combined concentric drivers.

An approach to addressing destructive interference is the concept of a genuine "infinite baffle," which is a flat surface that extends infinitely in all directions and lies perpendicular to the direction of sound pressure wave propagation to separate sound pressure waves generated by the front and back of a driver. In a genuine infinite baffle, sound pressure waves generated by the front and back of a driver will never meet because the baffle physically separates the sound pressure waves out to infinity.

An approximation of an infinite baffle is a conventional "sealed" or "closed" cabinet, which approximates an infinite baffle by substantially isolating the sound pressure waves generated by the front and back of a driver. The larger the sealed cabinet is, the less the air inside the cabinet will alter the compliance of the driver. Thus, larger sealed cabinets can closely approximate a genuine infinite baffle. Sealed cabinets block sound pressure waves generated by the back of a driver, and thereby trap the out of phase sound pressure waves to prevent them from combining with and cancelling out sound pressure waves generated by the front of the driver.

A conventional "ported" or "vented" cabinet is similar to a sealed cabinet, except it also includes a relatively small, open vent or port generally located at either the front or back of the cabinet, through which some of the sound pressure waves may escape. The vent or port transforms sound pressure waves by introducing an approximately 180 degree phase shift, which substantially avoids destructive interference or cancellation of sound pressure waves. A "ported" cabinet utilizes the sound pressure waves generated by both the front and, at reduced ranges, the back of a driver.

Both the "sealed" and "ported" approaches to cabinetry design have certain disadvantages. Because air is trapped behind the driver in a "sealed" or "closed" cabinet, the movement of the driver is modified, resulting in untrue movement of the driver. Thus, the cabinet size, driver size and audio driver mass need to be carefully selected in a sealed cabinet. In addition, while sealed cabinets are relatively simple to design and construct, they are inefficient because the sound pressure waves generated by the back of the driver are not used to generate sound pressure levels that are intended to be perceived by a listener. A ported cabinet is generally more difficult to design and build than a sealed cabinet, and also tends to be larger in size than a sealed cabinet.

In addition, both sealed and ported cabinet designs, by completely or partially enclosing the sound pressure waves generated by the back of a driver, suffer from pressure build-up, which leads to vibrations in the cabinet itself and distortion of the sound pressure waves. Sealed and ported audio cabinets are often constructed from dense materials in order to mitigate these vibrations.

In view of these relative disadvantages of conventional cabinet designs, there is a need for a cabinet that maximizes the use of sound pressure waves generated by both the front and back of a driver, that contours with the shape of sound pressure waves produced by a round, open-back, cone type driver and accordingly focuses the linear movement of those sound pressure waves, that mitigates cancellation and distortion of the sound pressure waves, and that can be achieved with a relatively simple design and lightweight construction. Embodiments of the present invention, as described below, address this need in the art for such a cabinet design.

SUMMARY OF THE INVENTION

Embodiments of the present invention are directed to a barrel-shaped cabinet, open at each end, having an internal mounting ring configured for receiving a round, open-back, cone type driver. A round, open-back, cone type driver is secured to the mounting ring within the cabinet, such that the driver effectively divides the barrel-shaped cabinet into two discrete, open chambers, one to each of the two output sides of an audio speaker. Embodiments of the invention allow sound pressure waves generated by both the front and back of the round, open-back, cone type driver to pass linearly and substantially unobstructed through the respective front and back chambers and through the open ends of the cabinet. Embodiments of the present invention simulate a genuine infinite baffle by substantially isolating the sound pressure waves generated by the front and back of the driver. Embodiments of the present invention also mitigate cancellation of sound pressure waves, that would typically be discernable to the human ear, by simulation of a genuine infinite baffle The sound pressure waves generated by the front and back of the driver are separated into respective front and back chambers of the cabinet, and are directed linearly through these chambers to the respective front and back open ends, creating a spatial differential between the waves exiting each open end. The diameters of the open ends of the cabinet are smaller than the diameter of the center of the cabinet, to facilitate the provision of a substantially smooth, concave internal cabinet surface (wall) that may minimally compress sound pressure waves and may optionally introduce back pressure, depending on the degree of concavity. The substantially smooth internal wall of the cabinet focuses the sound pressure waves exiting the open ends of the cabinet, and propagating through the physical space surrounding the cabinet.

By reducing the size of each open end, to a size smaller than that of the speaker cone of the driver, the wall may be used to compress sound pressure waves and introduce back pressure (e.g., to enhance performance of certain drivers). Back pressure is a compression of the air molecules (sound pressure waves) inside the cabinet resisting the movement of the speaker cone. Back pressure, if desirable for a specific driver's performance, can be introduced and regulated by adjusting the size of the open end of each chamber. The extent of compression and back pressure will depend on the degree of concavity, and the difference between the diameter of the speaker cone of the driver and the diameter of the open ends of the cabinet. The resulting sound pressure waves exiting the open ends of the cabinet propagate through the physical space surrounding the cabinet without noticeable cancellation.

Sound pressure waves move by passing energy from molecule to molecule, which radiate outwardly in spheres from the point of origination. A driver produces two semi-spheres of sound pressure waves: front waves and back waves which, collectively, constitute a sphere of sound pressure waves. As the sound pressure waves produced by the round, open-back, cone type driver reach the round, concave inner wall of the cabinet, the waves continue along the wall, which guides the molecules of the sound pressure waves, thereby focusing the waves prior to exiting the open ends of the cabinet.

The overall length of the cabinet (which may be used to control the spatial differential between the waves exiting each open end), the diameter of the center of the cabinet (which may be used to provide, for example, more of a tight, crisp sound, or an open, throaty sound), the diameters of the open ends of the cabinet (which may be used to control the degree of linear focus of the directional sound pressure waves, and provide back pressure, if desired), and the placement of the mounting ring for the open-back, cone type driver within the cabinet (which may be used to control the cone placement, and adjust to specific characteristics of a particular driver) are each variable. The desired dimensions and placement will depend, for example, on the size, characteristics, and cone depth of the round, open-back, cone type driver that is to be used, the desired sound output quality (e.g., timbre), and the amount, if any, of desired sound pressure wave compression or the addition of back pressure. A higher degree of concavity in the cabinet will introduce a greater degree of sound pressure wave compression and back pressure. Like conventional loudspeakers, the placement of the cabinet within a room or physical space is variable, and will depend on a multiplicity of factors such as the dimensions and characteristics of the room or physical space.

Embodiments of the cabinet thus provide for efficient utilization of a driver's total sound output per watt of energy input, by allowing sound to emanate from both the front and back of the open-back, cone type driver in a manner that can be heard by a listener. Embodiments of the cabinet substantially avoid distortion of the sound pressure waves generated by both the front or back of the driver, by allowing the sound pressure waves to pass linearly and substantially unobstructed through the respective front and back chambers and through the open ends of the cabinet. Embodiments of the cabinet also substantially avoid distortion of the sound pressure waves generated by the front and back of the driver, by avoiding the pressure build-up that typically occurs in enclosed or partially enclosed cabinets. The avoidance of pressure build-up allows embodiments of the cabinet to be constructed from lightweight materials, in a cost-effective manner.

In certain embodiments, the length of the cabinet can be between approximately 100% to approximately 250% of the diameter of the driver to be accommodated.

In certain embodiments, the diameter of the cabinet at the midpoint of the length of the cabinet can be between approximately 100% to approximately 250% of the diameter of the driver to be accommodated.

In certain embodiments, the diameters of the open ends of the cabinet can be between approximately 50% and approximately 250% of the diameter of the driver to be accommodated, such that the diameters of the open ends of the cabinet are smaller than the diameter of the center of the cabinet.

In certain embodiments, the open ends of the cabinet can be covered with a grill cloth, which protects the driver from dust or other objects.

In certain embodiments, the mounting ring can be positioned between approximately the front quarter and back quarter along the length of the cabinet. For example, if a cabinet is 24 inches long, the driver can be placed between approximately the 6 inch mark and the 18 inch mark.

Embodiments of the cabinet may be manufactured in a single piece, for example through injection molding, or from two or more pieces, for example through conventional barrel construction techniques.

In certain embodiments, the cabinet is made from a material selected from the group consisting of organic material, metal, and polymers. Organic materials may include wood, hemp, straw, and clay. Metals may include aluminum, stainless steel, and copper. Polymers may include plastics, fiberglass, and rubber.

DETAILED DESCRIPTION OF EMBODIMENTS OF THE INVENTION

Figure 1A:
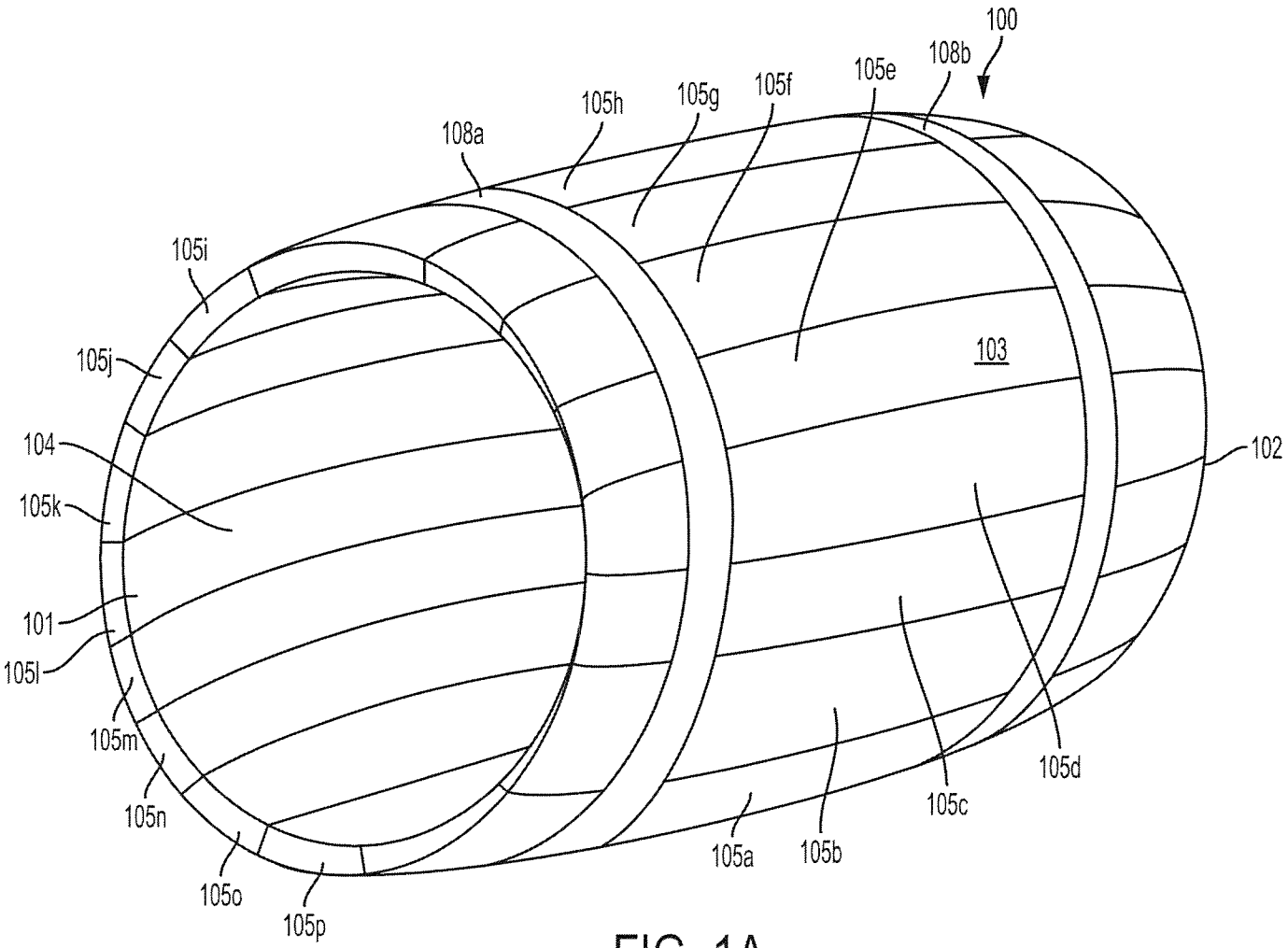
FIG. 1A depicts an exemplary front perspective view of a barrel-shaped cabinet, without a mounted driver.
Figure 2:
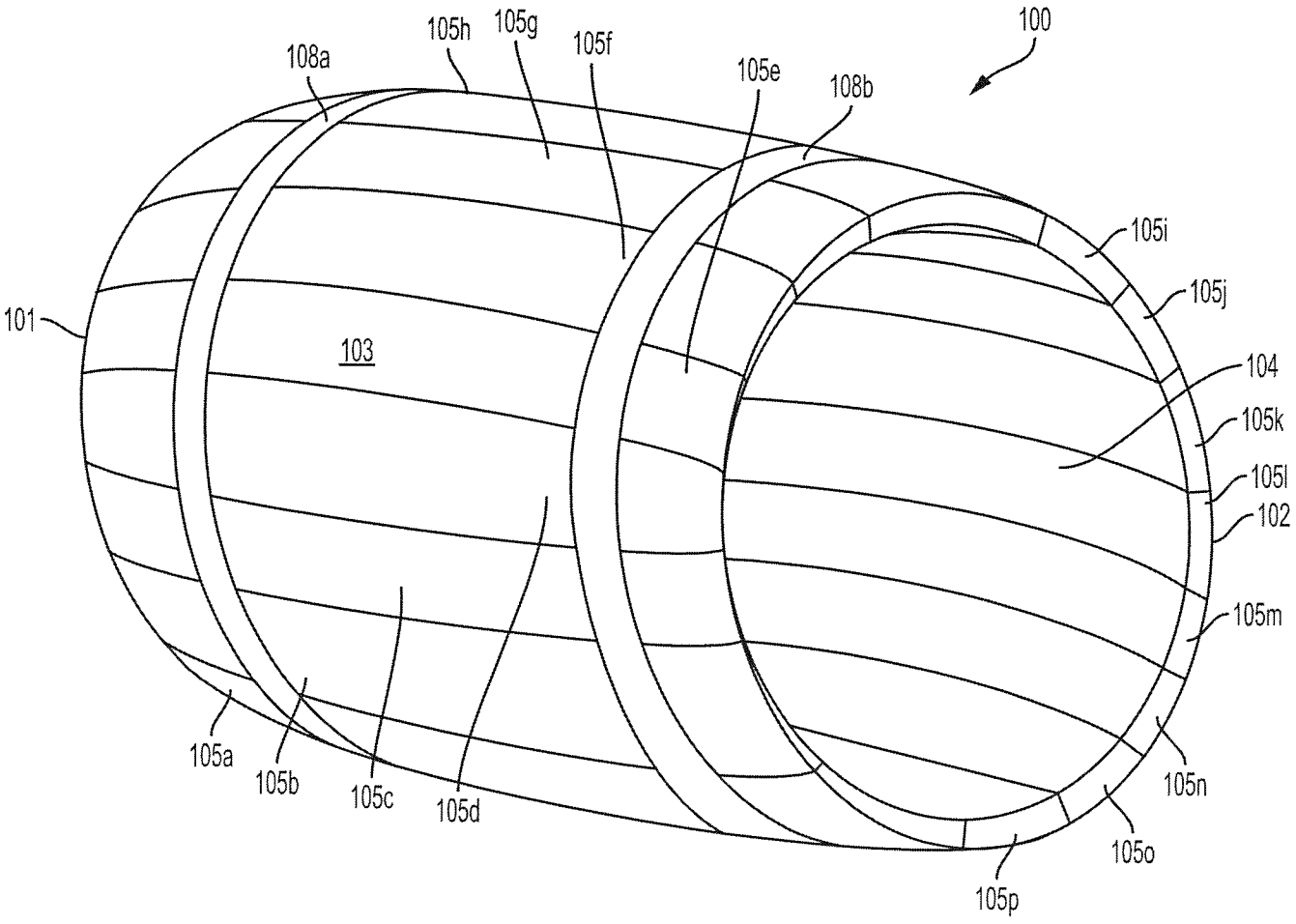
FIG. 2 depicts an exemplary back perspective view of the barrel-shaped cabinet of FIG. 1A.
Figure 6:
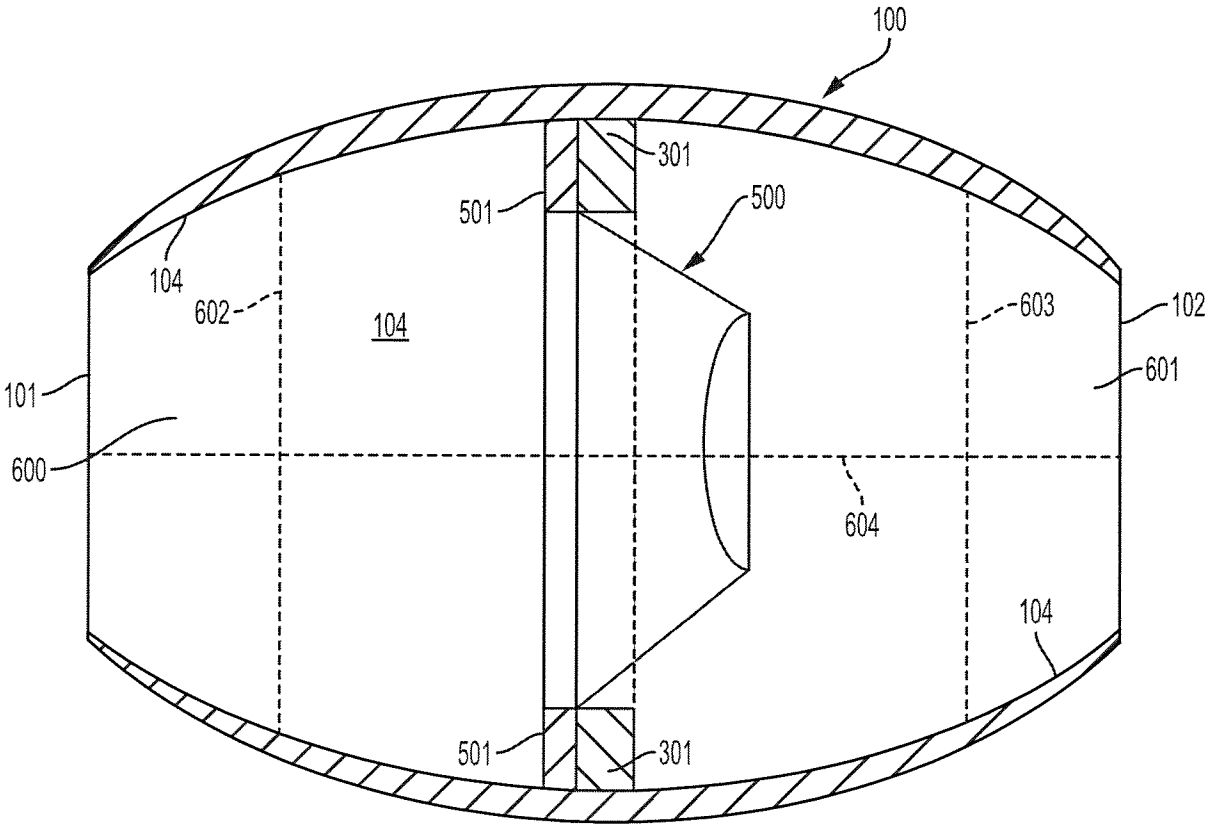
FIG. 6 depicts an exemplary cross-section view of the barrel-shaped cabinet along line 6-6 of FIG. 5.

FIGS. 1A and 2-4 provide exemplary views of an embodiment of the present invention. FIG. 1A depicts an exemplary front perspective view of a barrel-shaped cabinet 100, without a mounted driver, and FIG. 2 depicts an exemplary back perspective view of the barrel-shaped cabinet 100 of FIG. 1A. As shown in FIGS. 1A and 2, the barrel-shaped cabinet 100 has an open front end 101, an open back end 102, a substantially circumferential external wall 103 and a substantially circumferential internal wall 104 composed of a plurality of staves 105*a-p* of a material such as wood or plastic. Generally, when staves 105*a-p* are used, walls 103, 104 can form a polygon, or a substantially curvilinear surface. For a given cabinet 100, staves 105*a-p* may have a substantially same maximum width or have different maximum widths. Thus, the number, maximum width, and length of staves 105*a-p* can be varied to achieve a desired length 604 (as shown in FIG. 6) of the cabinet 100, and a desired circumference (and diameter) at the midpoint along length 604, and at the open ends 101, 102 of the cabinet 100. Staves 105*a-p* may be wood staves that are all one species of wood, or two or more species. Staves 105*a-p* may also be laminated, or solid.

Conventional hoops 108*a*, 108*b* are provided to facilitate holding staves 105*a-p* in place. Any desired number of hoops can be utilized. Each hoop can be placed in any desired location(s) on external wall 103. Hoops 108*a*, 108*b* can also be of any desired width, and made from a conventional hoop material, such as galvanized steel.

Figure 3:
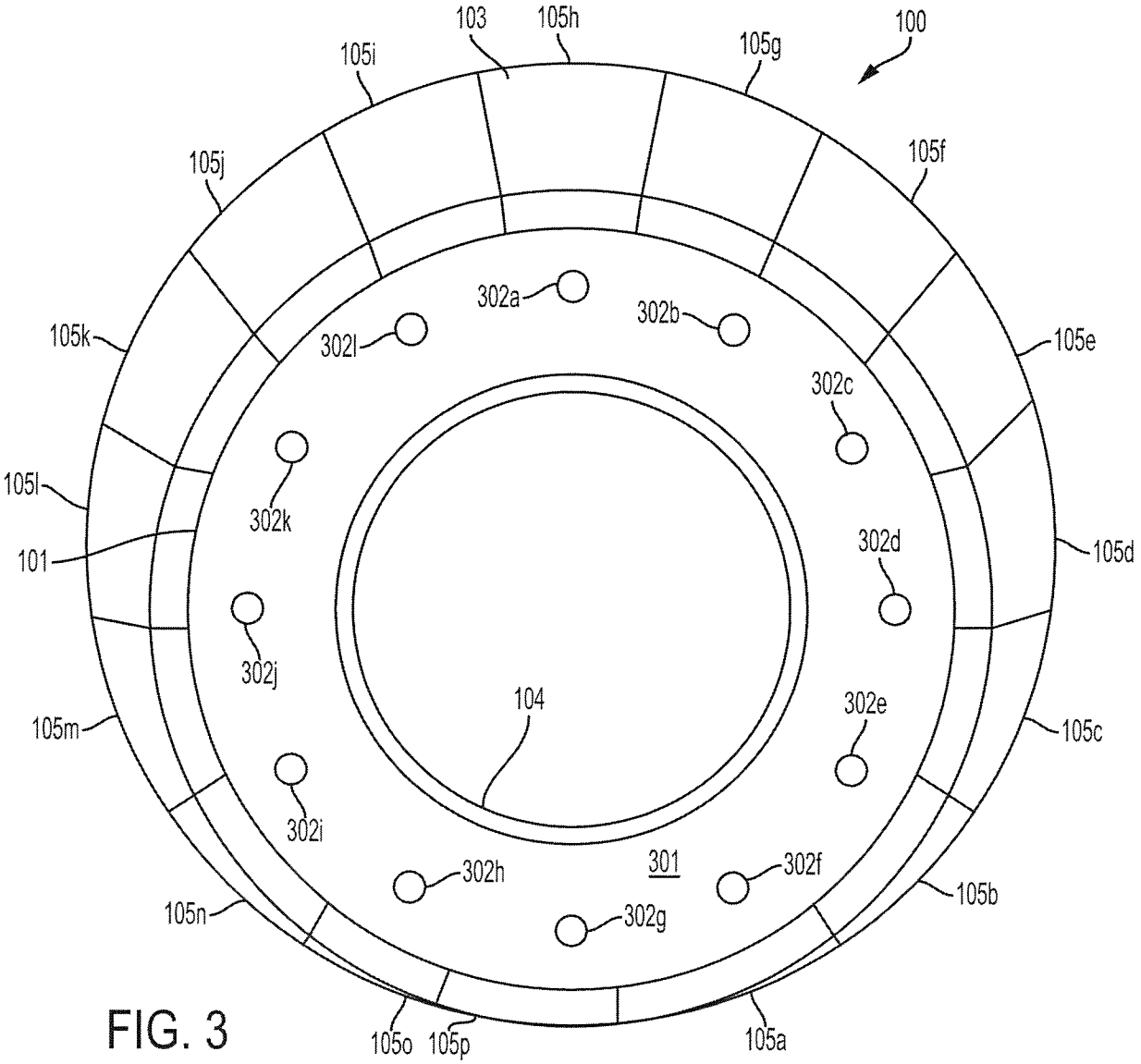
FIG. 3 depicts an exemplary front view of the barrel-shaped cabinet of FIG. 1A.
Figure 4:
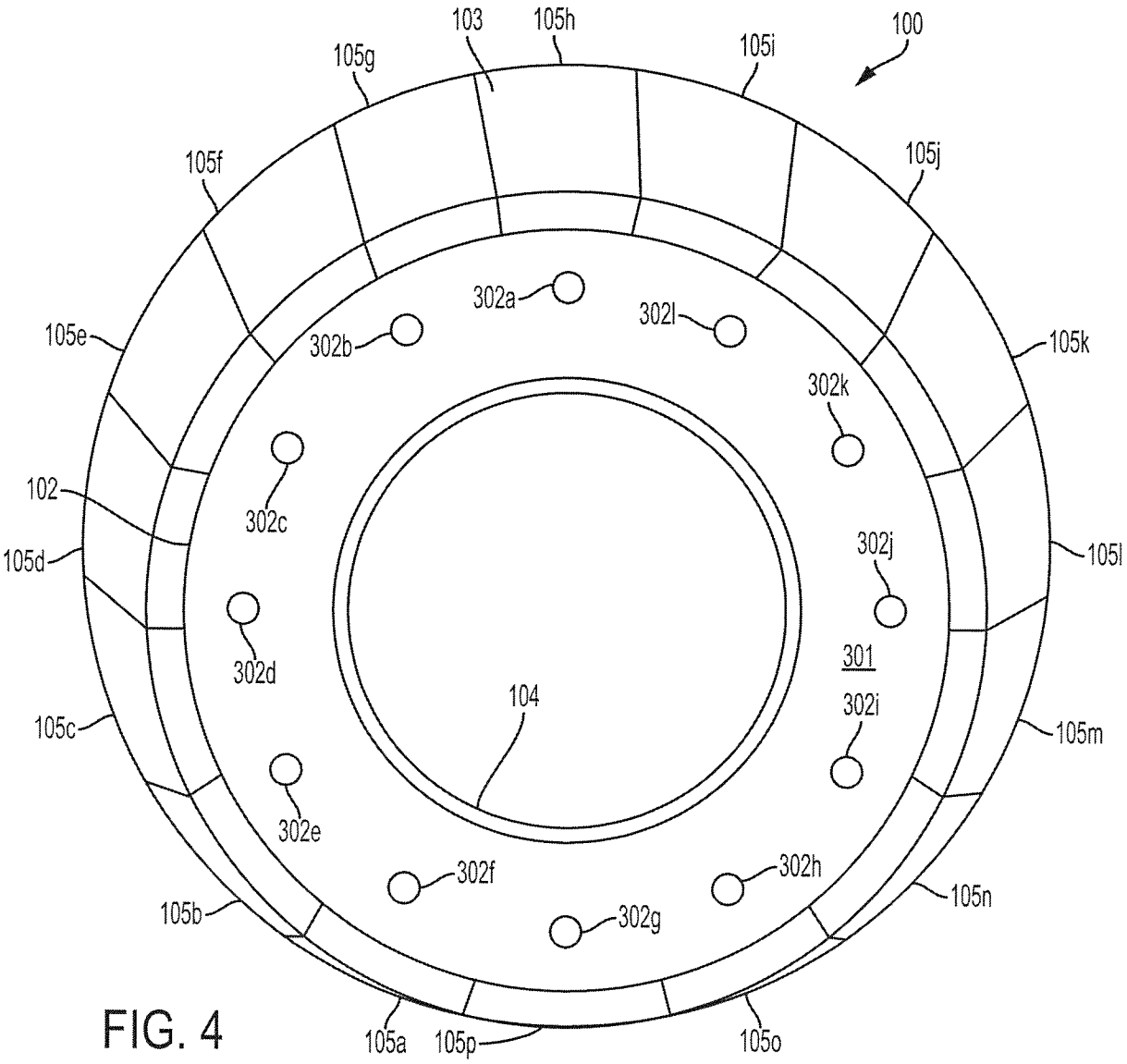
FIG. 4 depicts an exemplary back view of the barrel-shaped cabinet of FIG. 1A.

FIG. 3 depicts an exemplary front view of the barrel-shaped cabinet of FIG. 1A, and FIG. 4 depicts an exemplary back view of the barrel-shaped cabinet of FIG. 1A. As shown in FIGS. 3 and 4, the cabinet 100 also has a mounting ring 301 that has a plurality of holes 302*a-l* for fastening the driver (such as driver 500 shown in FIGS. 5-7) to the mounting ring 301 by using, for example, bolts, nuts, screws, and the like. Other fastening mechanisms can be used, such as glue, and rivets. Mounting ring 301 can be held in place to internal wall 104 by using a variety of conventional fastening and securing techniques, such as i) press fit, ii) glue, iii) screws, iv) brackets and screws, v) brackets, nuts and bolts, and the like. For example, screws may originate outside of cabinet 100, and extend through one or more staves 105*a-p* to hold mounting ring 301 in place.

Figure 1B:
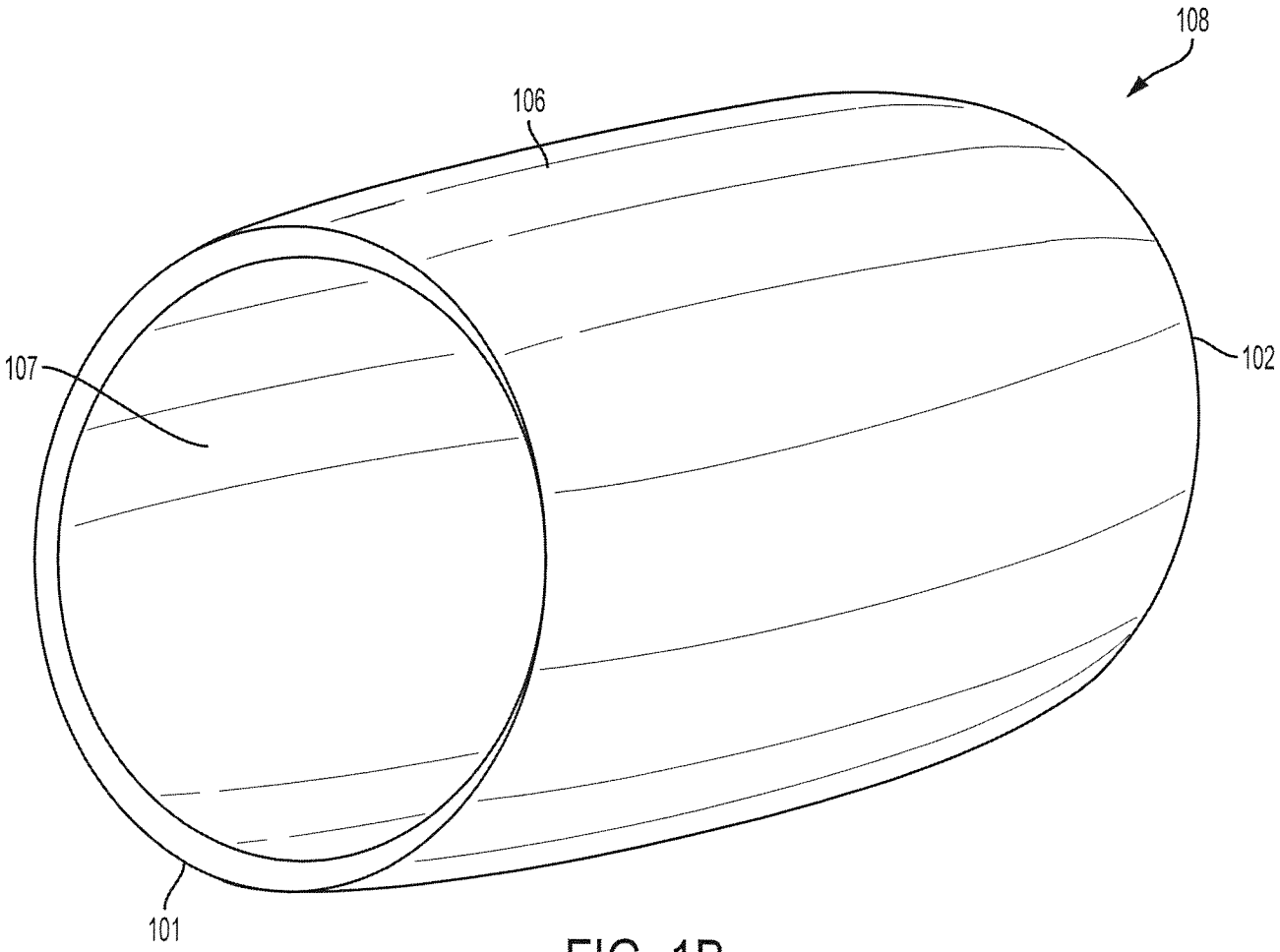
FIG. 1B depicts an alternate exemplary front perspective view of a barrel-shaped cabinet, without a mounted driver.

FIG. 1B depicts an alternate exemplary front perspective view of a barrel-shaped cabinet 108, without a mounted driver, such that the cabinet 108 is substantially integral, rather than using a plurality of discrete staves 105*a-p* as shown in FIGS. 1A and 2-7. Cabinet 108 can be made from plastic by using, for example, conventional injection molding techniques. The cabinet 108 has an open front end 101, an open back end 102, a substantially circumferential external wall 106 and a substantially circumferential internal wall 107. The cabinet 108 also has an internal mounting ring (such as the mounting ring 301 or 901 shown in FIGS. 8A-8B and 9A-9B, respectively), which may be integral with the cabinet 108, or a separate piece that is affixed to the cabinet 108 by using conventional fastening and securing techniques, as described above.

Figure 5:
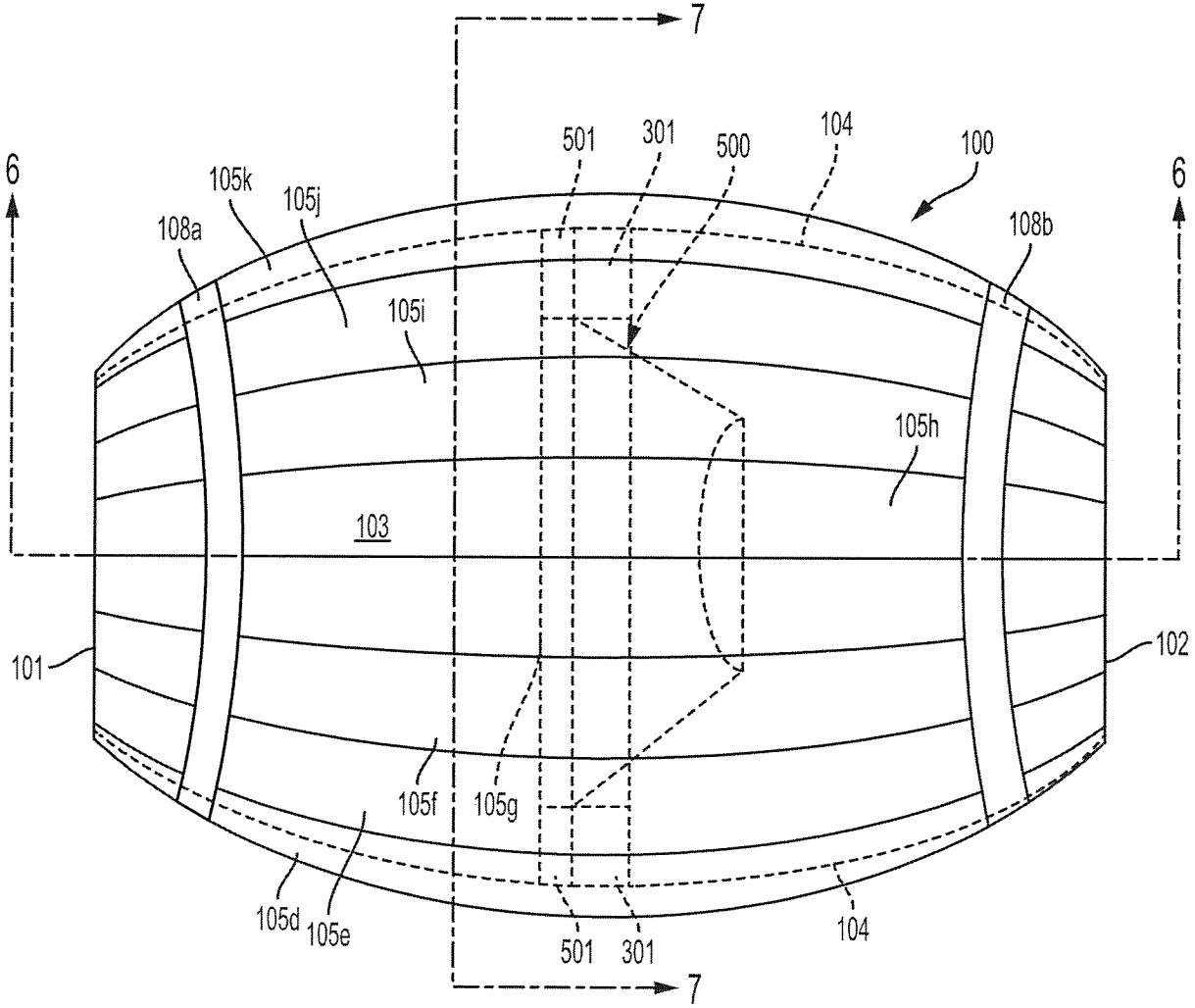
FIG. 5 depicts an exemplary top view of the barrel-shaped cabinet of FIG. 1A, with a mounted driver.
Figure 7:
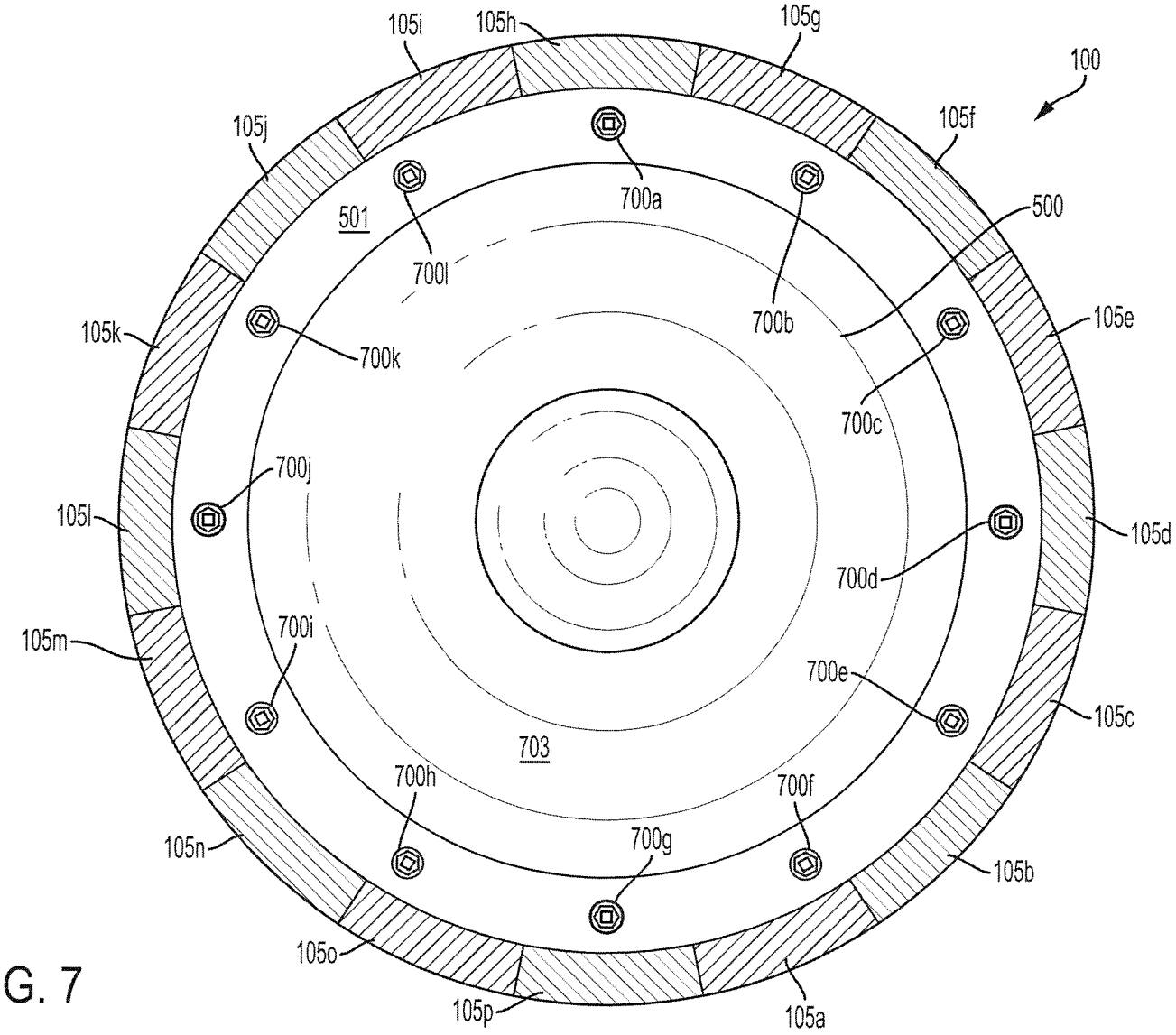
FIG. 7 depicts an exemplary cross-section view of the barrel-shaped cabinet along line 7-7 of FIG. 5.

FIG. 5 depicts an exemplary top view of FIG. 1A, illustrating an embodiment of a barrel-shaped cabinet 100 of FIG. 1A, containing a round, open-back, cone type driver 500, and a mounting ring 301 for the driver 500. The driver 500 has an outer diameter 501 that can be aligned with mounting holes 302*a-l*, so that the outer diameter 501 of driver 500 can be mounted to the mounting ring 301 via mounting holes 302*a-l*, as shown in FIGS. 3, 4 and 7. In this embodiment, mounting ring 301 and driver 500 are positioned at approximately the midpoint along the length 604 (as shown in FIG. 6) of the cabinet 100. A cable (not shown) can be used in a conventional manner to connect the driver 500 to a power source (e.g., amplifier) to convert an electrical audio signal to sound waves that are directed to the front 101 and back 102 ends.

FIG. 6 depicts an exemplary cross-section view of the barrel-shaped cabinet 100 along line 6-6 of FIG. 5. The driver 500 serves to divide the cabinet 100 into a front chamber 600 and a back chamber 601. Generally, the mounting ring 301 may be positioned, for example, approximately between the front quarter 602 and back quarter 603 of the cabinet 100, which has a length 604.

FIG. 7 depicts an exemplary cross-section view of the barrel-shaped cabinet 100 along line 7-7 of FIG. 5. As shown, driver 500 has a driver cone 703 which determines the size (e.g., diameter in inches) of the driver 500, and a plurality of holes on the outer diameter 501 to receive a respective plurality of bolts, nuts, screws, etc. 700*a-l*, as previously described, to secure driver 500 to the respective plurality of mounting holes 302*a-l* (not shown) of mounting ring 301 (not shown). Thus, outer diameter 501 is generally not used to determine the size of the driver 500.

Figure 8A:
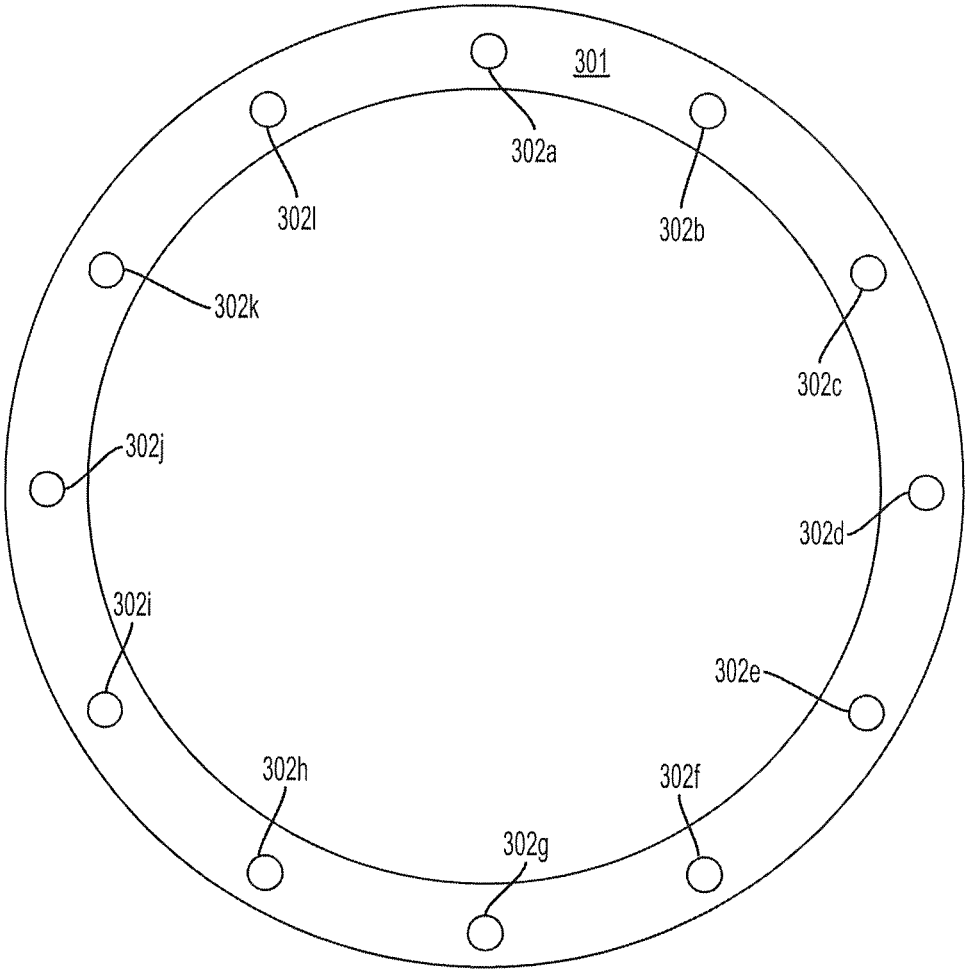
FIG. 8A depicts the top view of an exemplary mounting ring.
Figure 8B:
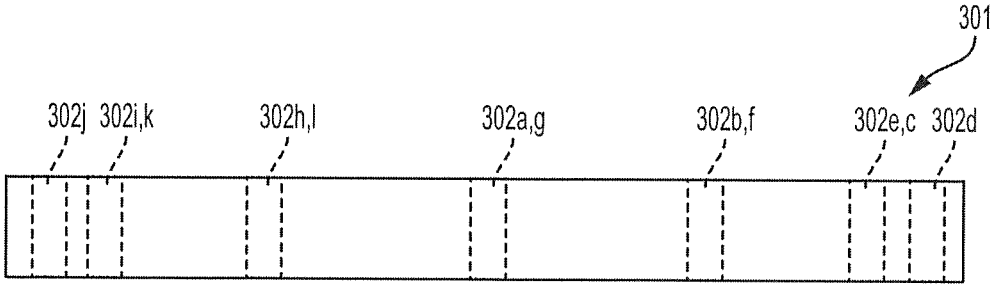
FIG. 8B depicts a side view of the mounting ring of FIG. 8A.

FIG. 8A depicts the top view of an exemplary mounting ring 301, containing a plurality of holes 302*a-l* for mounting a driver 500 with bolts or screws 700*a-l*, as shown in FIG. 7. FIG. 8B depicts a side view of the mounting ring 301 of FIG. 8A.

Figure 9A:
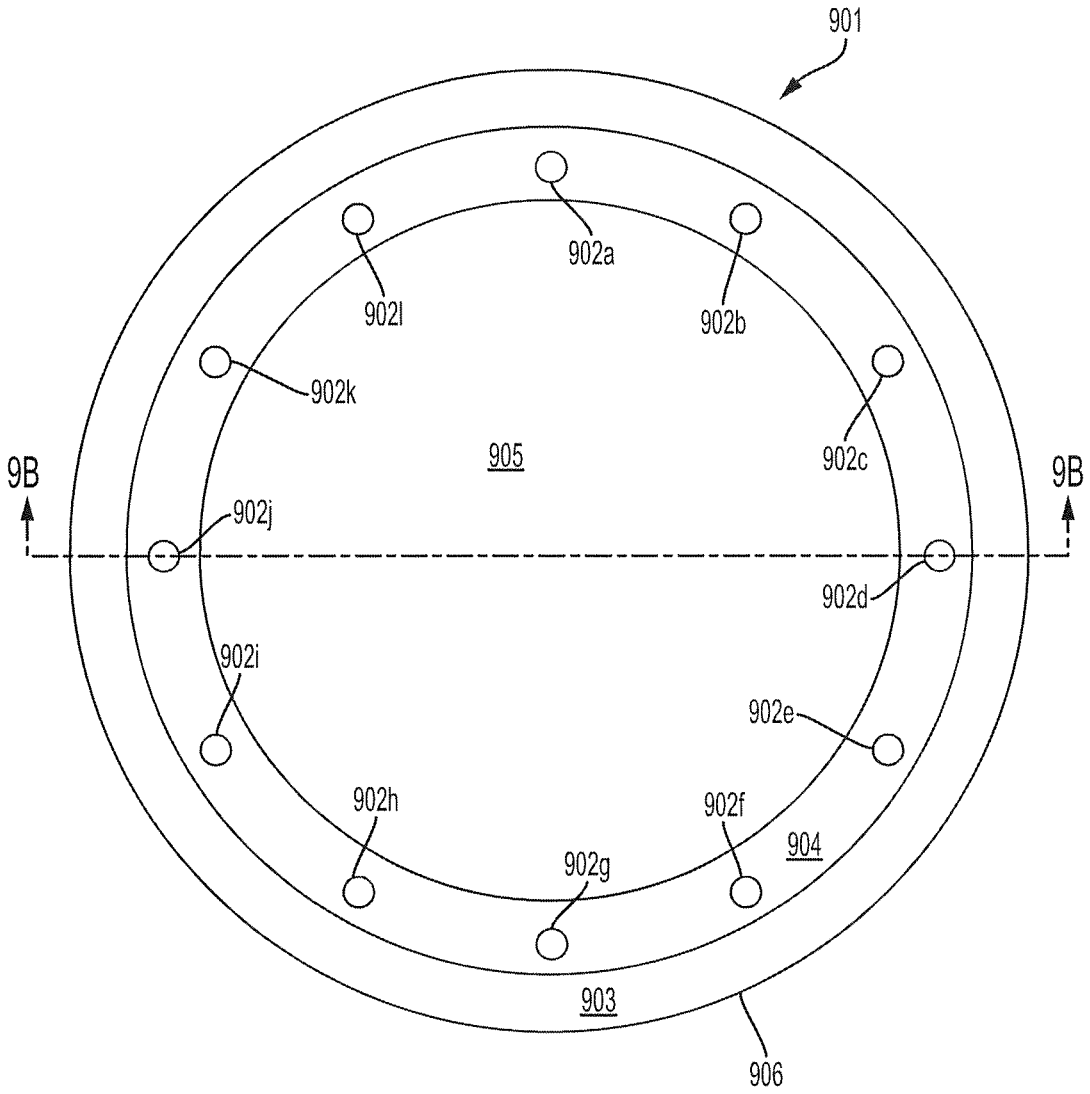
FIG. 9A depicts the top view of an alternative mounting ring embodiment.
Figure 9B:
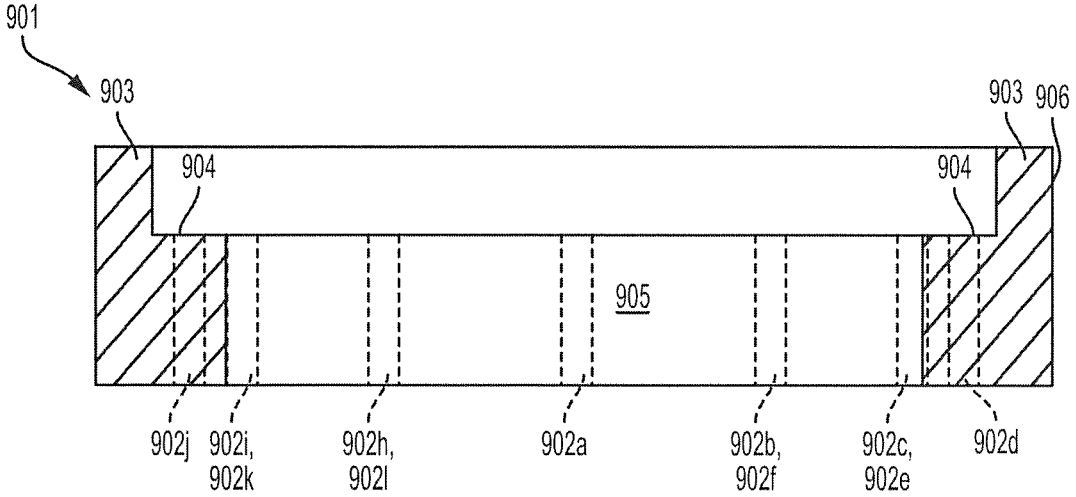
FIG. 9B depicts a cross section view of the mounting ring along line 9B-9B of FIG. 9A.

FIG. 9A depicts the top view of an alternative mounting ring embodiment 901, having an outer periphery 903 and a driver contact surface 904. The driver contact surface 904 contains a plurality of holes 902*a-l* for mounting the outer diameter 501 of driver 500 with bolts or screws 700*a-l* (not shown), in a same or substantially similar manner as shown in FIG. 7. In this embodiment, a mounted driver (such as driver 500 shown in FIGS. 5-7) occupies the driver cone region 905, with the outer periphery 903 of the mounting ring extending past the outer diameter of the driver. In this embodiment, mounting ring 901 has a cabinet contact surface 906, which may be fastened or secured to an internal cabinet wall (such as internal wall 104 shown in FIGS. 1A and 2-6) through a variety of conventional fastening and securing techniques, as described above. FIG. 9B depicts a cross section view of the mounting ring 901 along line 9B-9B of FIG. 9A.

The cabinet 100 and mounting rings 301, 901 may be composed of a material selected from the group consisting of organic material, metal, and polymers. In embodiments, such as FIG. 1B, the cabinet 108 and mounting ring (not shown) may be a single piece and manufactured, for example, by using conventional injection molding processes and techniques. The cabinet 108 of FIG. 1B has an integral external wall 106, and an integral internal wall 107. Alternatively, the cabinet 108 and mounting ring (not shown) may be manufactured as separate pieces, each by using, for example, conventional injection molding processes and techniques.

In certain embodiments, the front open end 101 and the back open end 102 may be covered with a grill cloth (not shown), which protects the driver 500 from dust or other objects.

Figure 10:
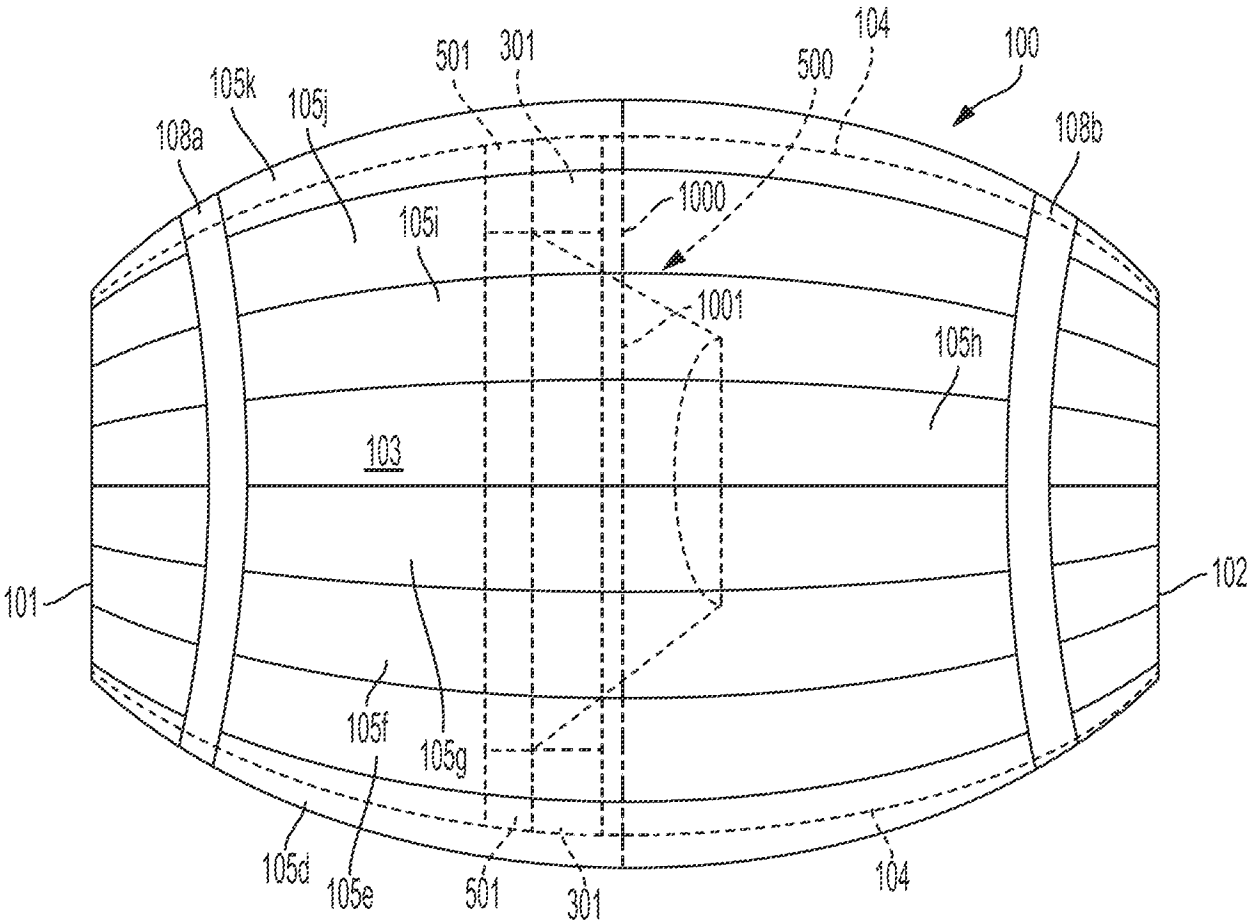
FIG. 10 is an exemplary top view, similar to FIG. 5, of an embodiment of a cabinet and a round, open-back, cone type driver, with the center of the cone aligned with the midpoint of the internal wall and the mounting ring offset from the center of the internal wall.

FIG. 10 is an exemplary top view, similar to FIG. 5, of an embodiment of a cabinet 100 and a round, open-back, cone type driver 500, with the center of the cone 1001 aligned with the midpoint 1000 of the internal wall 104 and the mounting ring 301 offset from the midpoint 1000 of the internal wall 104. The mounting ring 301 is configured for receiving the driver 500 in a manner such as described in FIG. 5, and is secured to the internal wall 104 at a position offset from the midpoint 1000 of the internal wall 104. The driver 500 is mounted on the mounting ring 301 such that a center of the cone portion 1001 of the driver 500 in the axial direction aligns with the midpoint 1000 of the internal wall 104. The outer diameter 501 of driver 500 can be mounted to the mounting ring 301 via mounting holes 302*a*-1, as shown in FIGS. 3, 4 and 7.

The following examples of various embodiments are illustrative. In certain embodiments, the length 604 of the cabinet 100 is between 100% and 250% of the diameter (as determined by the diameter of driver cone 703) of the round, open-back, cone type driver 500. For example, the length 604 of the cabinet 100 may be between 6 and 15 inches for a driver 500 having a driver cone 703 diameter of 6 inches. In another example, the length 604 of the cabinet 100 may be between 12 and 30 inches for a driver 500 having a driver cone 703 diameter of 12 inches. In yet another example, the length 604 of the cabinet 100 may be between 18 and 45 inches for a driver 500 having a driver cone 703 diameter of 18 inches.

In certain embodiments, the diameters of the front open end 101 and back open end 102 are between 50% and 250% of the diameter of the driver cone 703 of driver 500. For example, the diameters of the front open end 101 and back open end 102 may be between 3 and 15 inches for a driver 500 having a driver cone 703 diameter of 6 inches. In another example, the diameters of the front open end 101 and back open end 102 may be between 6 and 30 inches for a driver 500 having a driver cone 703 diameter of 12 inches. In yet another example, the diameters of the front open end 101 and back open end 102 may be between 9 and 45 inches for a driver 500 having a driver cone 703 diameter of 18 inches.

In certain embodiments, the inner diameter of the cabinet 100 (the diameter of internal wall 104) at the midpoint along the length 604 of the cabinet 100 is between 100% and 250% of the diameter of the driver cone 703. For example, the diameter at the center of the cabinet 100 at the midpoint of the length 604 of the cabinet 100 may be between 6 and 15 inches for a driver cone 703 having a diameter of 6 inches. In another example, the diameter of the cabinet 100 at the midpoint of the length 604 of the cabinet 100 may be between 12 and 30 inches for a driver cone 703 having a diameter of 12 inches. In yet another example, the diameter of the cabinet 100 at the midpoint of the length 604 of the cabinet 100 may be between 18 and 45 inches for a driver cone 703 having a diameter of 18 inches.

EXAMPLES

Example 1

A barrel-shaped cabinet having a) a mounting ring placed in the internal portion of the cabinet at the midpoint of the cabinet, b) a Seismic Audio Jolt-8, 8" driver (Seismic Audio Speakers Inc., Memphis, Tenn.) secured to the mounting ring, c) an overall length of 14 inches, d) a center diameter of 9 inches, and e) open ends having diameters of 8 inches.

Example 2

A barrel-shaped cabinet having a) a mounting ring placed in the internal portion of the cabinet, offset 1.75 inches from the center of the cabinet, b) a Dayton Audio DA270-8 (3.5-inch cone depth), 10" driver (Dayton Audio, Springboro, Ohio) secured to the mounting ring such that the center of the cone aligns with the center of the cabinet, c) an overall length of 16 inches, d) a center diameter of 12 inches, and e) open ends having diameters of 10.5 inches.

Example 3

A barrel-shaped cabinet having a) a mounting ring placed in the internal portion of the cabinet at the center of the cabinet, b) a Seismic Audio—Denali 12, 12" driver (Seismic Audio Speakers, Inc., Memphis, Tenn.) secured to the mounting ring, c) an overall length of 19 inches, d) a center diameter of 16 inches, and e) open ends having diameters of 14 inches.

Example 4

A barrel-shaped cabinet having a) a mounting ring placed in the internal portion of the cabinet at the center of the cabinet, b) a HH Electronics—PA12, 12" driver (HH Electronics, Halesowen, West Midlands, UK) secured to the mounting ring, c) an overall length of 27 inches, d) a center diameter of 21 inches, and e) open ends having diameters of 18 inches.

Example 5

A barrel-shaped cabinet having a) a mounting ring placed in the internal portion of the cabinet, offset 0.5 inches from the center of the cabinet, b) an Eminence ALPHA 4 driver (Eminence Speaker LLC, Eminence Ky.) secured to the mounting ring, such that the center of the cone aligns with the center of the cabinet, c) an overall length of 8 inches, d) a center diameter of 4.5 inches, and e) open ends having diameters of 3.75 inches.

What is claimed is:

1. A cabinet and a round, open-back, cone type driver, comprising:

the cabinet; and the cone type driver, wherein the cabinet comprises:

a continuously concave barrel-shaped internal wall along an axial direction of the cabinet comprising first and second opposing open ends and a substantially circular cross section, wherein the diameter of the cross section at a midpoint of the continuously concave barrel-shaped internal wall in the axial direction is greater than the diameter of the internal wall at the opposing open ends; and a mounting ring, configured for receiving the driver, secured to the internal wall at a position offset from the midpoint of the internal wall, and wherein the driver is mounted on the mounting ring such that a center of the cone portion of the driver in the axial direction aligns with the midpoint of the internal wall.

2. The cabinet and the driver according to claim 1, wherein a length of the cabinet is between approximately 100% to 250% of the diameter of the cone portion of the driver.

3. The cabinet and the driver according to claim 2, wherein the length of the cabinet is approximately 200% of the diameter of the cone portion of the driver.

4. The cabinet and the driver according to claim 1, wherein the diameter of the cross section at the midpoint of the internal wall is between approximately 100% to 250% of the diameter of the cone portion of the driver.

5. The cabinet and the driver according to claim 4, wherein the diameter of the cross section at the midpoint of the internal wall is approximately 110% of the diameter of the cone portion of the driver.

6. The cabinet and the driver according to claim 1, wherein the diameters of the opposing open ends are between approximately 50% to 250% of the diameter of the cone portion of the driver.

7. The cabinet and the driver according to claim 6, wherein the diameters of the opposing open ends are approximately 100% of the diameter of the cone portion of the driver.

8. The cabinet and the driver according to claim 1, wherein the cabinet is manufactured using an injection molding process.

9. The cabinet and the driver according to claim 1, wherein an orientation of a plane formed tangentially with respect to a point on a surface of the continuously concave barrel-shaped internal wall varies along the axial direction.

10. A method for simulating a genuine infinite baffle, comprising:

providing a cabinet with a continuously concave barrel-shaped internal wall along an axial direction of the cabinet comprising first and second opposing open ends and a substantially circular cross section, wherein the diameter of the cross section at a midpoint of the continuously concave barrel-shaped internal wall in the axial direction is greater than the diameter of the internal wall at the opposing open ends;

providing a mounting ring configured for receiving a round, open-back, cone type driver;

securing the mounting ring to the internal wall at a position offset from the midpoint of the internal wall;

mounting the cone type driver to the mounting ring such that a center of the cone portion of the driver in the axial direction aligns with the midpoint of the internal wall; and using the driver to convert an electrical audio signal to sound pressure waves that are directed to the first and second opposing ends.

11. The method of claim 10, wherein the sound pressure waves directed to the first and second opposing ends pass substantially unobstructed through the opposing open ends.

* * * * *